US009793654B2

(12) United States Patent
Konrad et al.

(10) Patent No.: US 9,793,654 B2
(45) Date of Patent: Oct. 17, 2017

(54) COMMON GROUND CONNECTION CLAMP FOR AT LEAST ONE COAXIAL LINE

(71) Applicant: LEONI BORDNETZ-SYSTEME GMBH, Kitzingen (DE)

(72) Inventors: Thomas Konrad, Wuerzburg (DE); Gerhard Hein, Uffenheim (DE)

(73) Assignee: LEONI Bordnetz-Systeme GmbH, Kitzingen (DE)

( * ) Notice: Subject to any disclaimer, the term of this patent is extended or adjusted under 35 U.S.C. 154(b) by 68 days.

(21) Appl. No.: 14/513,403

(22) Filed: Oct. 14, 2014

(65) Prior Publication Data

US 2015/0031236 A1 Jan. 29, 2015

Related U.S. Application Data

(63) Continuation of application No. PCT/EP2013/001059, filed on Apr. 11, 2013.

(30) Foreign Application Priority Data

Apr. 13, 2012 (DE) ..... 10 2012 206 114

(51) Int. Cl.

| | |
|---|---|
| ***H01R 13/648*** | (2006.01) |
| ***H01R 4/30*** | (2006.01) |
| ***H01R 9/05*** | (2006.01) |
| *H01R 13/50* | (2006.01) |

(52) U.S. Cl.

CPC ..... *H01R 13/648* (2013.01); *H01R 4/30* (2013.01); *H01R 9/0524* (2013.01); *H01R 13/501* (2013.01); *H01R 2201/26* (2013.01)

(58) Field of Classification Search

CPC .. H01R 13/58; H01R 13/582; H01R 13/5825; H01R 13/5816; H01R 9/0524

USPC ..... 439/246, 252, 737, 724, 101, 791, 411, 439/97, 431, 428, 98, 781–782, 579, 792

See application file for complete search history.

(56) References Cited

U.S. PATENT DOCUMENTS

| | | | | |
|---|---|---|---|---|
| 1,346,525 A * | 7/1920 | Beetem | H01R 9/18 174/153 R |
| 2,287,035 A * | 6/1942 | Hubbell | H01R 4/38 439/737 |
| 3,568,128 A | 3/1971 | Taylor | |
| 4,280,746 A * | 7/1981 | Ignatowicz | H01R 13/582 439/470 |
| 4,708,665 A * | 11/1987 | Belka | B62J 6/00 439/551 |
| 5,122,068 A | 6/1992 | Koss | |

(Continued)

FOREIGN PATENT DOCUMENTS

EP 1571732 A1 9/2005

*Primary Examiner* — Renee Luebke
*Assistant Examiner* — Paul Baillargeon
(74) *Attorney, Agent, or Firm* — Laurence A. Greenberg; Werner H. Stemer; Ralph E. Locher

(57) ABSTRACT

The device allows simple ground contacting of the shielding of a coaxial line, in particular a parallel ground contacting. For this purpose the connection holder has a housing for receiving preferably multiple coaxial lines which are fed through the housing in a parallel manner. A ground contacting strip lies in the housing, and the shieldings of the coaxial lines, which are stripped in a contact region, are placed against the ground contacting strip and clamped thereagainst.

18 Claims, 3 Drawing Sheets

(56) References Cited

U.S. PATENT DOCUMENTS

| | | | | |
|---|---|---|---|---|
| 5,664,971 | A * | 9/1997 | Coy | H01R 4/363<br>439/791 |
| 5,713,748 | A | 2/1998 | Mulvihill | |
| 5,850,056 | A * | 12/1998 | Harwath | H01R 4/646<br>174/40 CC |
| 6,297,447 | B1 | 10/2001 | Burnett et al. | |
| 6,890,191 | B1 | 5/2005 | Thorburn | |
| 7,503,776 | B1 * | 3/2009 | Pavlovic | H01R 4/46<br>439/455 |

* cited by examiner

COMMON GROUND CONNECTION CLAMP FOR AT LEAST ONE COAXIAL LINE

CROSS-REFERENCE TO RELATED APPLICATION

This application is a continuation, under 35 U.S.C. §120, of copending international application No. PCT/EP2013/001059, filed Apr. 11, 2013, which designated the United States; this application also claims the priority, under 35 U.S.C. §119, of German patent application No. DE 10 2012 206 114.2, filed Apr. 13, 2012; the prior applications are herewith incorporated by reference in their entirety.

BACKGROUND OF THE INVENTION

Field of the Invention

The invention relates to a connection holder for connecting the shielding of at least one coaxial line, in particular for use in a motor vehicle.

Coaxial lines, or coaxial cables, generally comprise a central conductor that is encased by a dielectric in the form of an intermediate insulation and then by an outer conductor that is embodied as a shield. The shield is embodied as a film or a braid or the like that is wound around the dielectric and is itself in turn encompassed by an insulation of the coaxial line. The shield is generally connected in the installed state to ground potential. The connection holder is therefore used in this respect as a clamp to provide a connection to ground.

The coaxial lines are used as data transmission lines and by way of example for providing a connection to antennae. In modern motor vehicles, a number of antennae, by way of example up to 15 antennae, are currently installed. The antennae are connected in each case by way of a dedicated coaxial line to allocated control units.

In order for the shield to contact the ground potential, a metal cable clamp is generally provided for each individual coaxial conductor, the metal cable clamp is placed in a clamping manner on the shield after insulation has been stripped off and the metal cable clamp is fastened by way of example to a metal carrier that is connected to the ground potential.

However, this type of connection to ground is encumbered with the problem that the edges of the cable clamps penetrate the shield and consequently the connection to ground is less than adequate so that a malfunction can occur. This problem is particularly exacerbated by the vibrations that occur during the operation of a motor vehicle so that, as the operating life increases, a significant number of the antennae that are connected to the coaxial lines become inoperative.

These problems render it necessary to take extreme care during the assembly process which eventually leads to a high outlay and higher expenses.

SUMMARY OF THE INVENTION

It is accordingly an object of the invention to provide a common grounding clamp for one or more coaxial cables which overcomes the disadvantages of the heretofore-known devices of this general type and which provides for a permanently reliable ground contact of the shield of a coaxial line, in particular in a motor vehicle, while providing for a simple assembly process.

With the above and other objects in view there is provided, in accordance with the invention, a connection holder for connecting a shielding of one or more coaxial lines, the coaxial lines having a shielding encased by an outer insulation. The connection holder comprises:

a housing configured to receive the at least one coaxial line;

a ground contact strip disposed in said housing;

the at least one coaxial line having a contacting region where the outer insulation has been stripped and the shielding is exposed for placement on, and clamping against, said ground contact strip;

said ground contact strip being disposed in said housing to make direct contact with ground potential when the connection holder is fastened to a carrier component;

said housing having an opening formed therein for a fastening element for connecting said ground contact strip to ground potential, said opening being a through-hole screw opening with opposite-lying through-openings, and said ground contact strip having a through-opening formed therein; and wherein:

said fastening element is guided in an assembled state through said housing and contacts said ground contact strip, and a foot region of said fastening element forms an electrical contact with the carrier component; or said ground contact strip has a lower face formed with a contact protrusion that passes through said housing and forms a direct ground contact when said ground contact strip is fastened to the carrier component.

The connection holder, or common ground contact clamp, is used to connect to ground the shielding of at least one coaxial line, in other words to make contact with the shield of the coaxial line and provide a conductive connection of the shield to a ground potential. The connection holder encompasses an (insulating) housing that is embodied in particular from a synthetic material for the purpose of receiving the at least one coaxial line, wherein a ground contact strip that is embodied preferably as a metal plate or a sheet metal strip is arranged in the housing and in the assembled state the coaxial line that has been stripped of insulation in a contacting region is placed in a clamping manner against the the ground contact strip.

In contrast to the hitherto known ground connection systems having cable clamps, the contacting region where the insulation has been stripped off and consequently the shield are only pressed against the ground contact strip so that an electrical contact is produced. The arrangement of the preferably flat plate of the ground contact strip therefore does not pose any risk of the shield being cut and severed. The assembly process is preferably performed in such a simple manner that the coaxial conductor is inserted with the contacting region that has been stripped of insulation into the opened housing and is placed on the ground contact strip. The housing is subsequently closed and as a result the coaxial conductor is clamped. As a consequence, the assembly process is also simplified.

It is preferred that the at least one coaxial line passes through the housing, the housing therefore comprising an entry opening and also an exit opening for a respective coaxial line. Therefore, contact is not made in particular with the inner conductor in the connection holder itself. The inner conductor is encompassed by the intermediate insulation and is guided through the housing uninterrupted and in particular in a straight line.

The connection holder is embodied in an expedient manner for the purpose of receiving a plurality of coaxial lines so that it is possible to make contact in parallel with a plurality of individual coaxial lines.

The ground contact strip is preferably embodied only as a simple, in particular plate-shaped, insert part. Its upper surface facing the coaxial lines is optionally flat or also is provided with a structured surface, by way of example a rippled structure. The surface can also be provided with grooves for individually receiving the coaxial conductors.

For the purpose of guiding the coaxial lines, in particular shell-shaped guides for individually guiding each coaxial line are provided in an expedient manner on the housing. As a consequence, the coaxial lines can be placed in a simple manner into the guides.

The housing itself is preferably embodied from two housing parts and comprises a lower shell and a cover, and the coaxial lines are clamped between the two parts. In an expedient manner, each of the housing parts comprises half-shell shaped guides that in a complementary manner with respect to one another form one guide. For the purpose of exerting the clamping force, the two housing parts are fastened to one another. For this purpose, suitable fastening elements such as by way of example screws are provided. However, it is preferred that latching elements are arranged in particular on the opposite lying end faces.

The ground contact strip lies preferably in the lower shell in an essentially loose manner and extends in the longitudinal direction of the housing. In a transverse manner with respect to the longitudinal direction, the coaxial lines are guided through the housing in a transverse direction. The ground contact strip extends preferably almost over the entire length of the housing and comprises a width in the transverse direction of by way of example 1 to 3 cm and has a thickness by way of example of approx. 1 to 2 mm. The ground contact strip is delimited at the side in each case by a boundary connecting piece that is formed on the lower shell, wherein the half-shell shaped guides are embodied preferably in each case in these boundary connecting pieces.

For the purpose of fastening the stripped contacting region in a clamping manner, allocated clamping elements for the purpose of pressing against the contacting region that has been stripped of insulation are embodied in the cover of a respective coaxial line. These clamping elements are preferably embodied as clamping strips that are formed as one on the cover and extend in the transverse direction and preferably comprise a length that is adapted to suit the width of the ground contact strip.

In addition, for the purpose of further fixing the respective coaxial line, fixing pins are arranged in one of the two housing parts, preferably in the cover, in particular in the half-shell shaped guides, and the fixing pins exert an enhanced localized clamping force. In particular, the fixing pins are embodied in a tapering manner or extend to form a tip so that they penetrate at least in part into the insulation of the coaxial line and consequently also produce a form fit.

For the purpose of making contact with a ground potential, the ground contact strip is generally connected by way of an electric contact connection to the ground potential. It is fundamentally possible for this purpose to connect a ground line to the ground contact strip by way of example by means of a screw fastening and to guide this ground line to a ground potential, by way of example to a carrier component of the motor vehicle bodywork, by means of which a ground potential is formed.

However, for a simple assembly process, it is provided in accordance with a preferred embodiment variant that the ground contact between the ground contact strip and the ground potential is not provided by way of a separate ground line but rather is embodied directly when fastening the connection holder to a (carrier) component of this type.

For this purpose, it is provided in accordance with a first embodiment variant that an electrically conductive fastening element is guided through the housing and in doing so contacts the ground contact strip and the electrical contact is made simultaneously with its foot region with the carrier component.

In an expedient manner, the fastening part is embodied as a screw that is guided through a through-opening in the cover so that the screw lies with its screw head directly on the ground contact strip, wherein the shaft region of the screw is guided through a through-opening of the ground contact strip and further through a through-opening in the lower shell and is screwed into the carrier component. In the case of this embodiment variant, the clamping force that is exerted by the housing on the coaxial line is therefore exerted preferably exclusively by means of the connection of the two housing parts, in particular exclusively by way of the latched connections.

For fastening purposes, the ground contact strip generally comprises a through-opening for a fastening element, in particular the screw. It is preferred that the guides for the coaxial lines are embodied in a symmetrical manner on both sides of the through-opening.

For fixing purposes and also for centering purposes, an annular connecting piece is embodied on the housing in a preferred embodiment, the annular connecting piece being embodied in particular on the lower shell and engaging in a precisely fitting manner in the through-opening of the ground contact strip.

In accordance with a modified embodiment variant, the ground contact strip comprises on its lower face a contact protrusion that is guided through the lower shell in such a manner that the contact protrusion lies directly against the carrier.

As a consequence, the ground contact with the carrier is therefore embodied by way of the ground contact strip and not or not only by way of the fastening element. In the case of this embodiment variant, it is rendered possible and provided that the fastening means is supported on the cover and not automatically on the ground contact strip and as a consequence an additional or the single clamping force is exerted for the purpose of fastening the coaxial lines in a clamping manner.

It is preferred in the two variants that damping elements are provided for the purpose of decoupling vibrations between the motor vehicle carrier component (bare component) and the housing. The damping elements are by way of example in particular resilient insert disks.

In order to facilitate a simple assembly process, the housing comprises in particular on its lower face in addition additional fixing elements for the purpose of fixing to the carrier at a defined position. The additional fixing elements are embodied by way of example as connecting pieces formed as one thereon.

In an expedient manner, the connection holder is already equipped with the desired number of coaxial lines prior to the actual assembly process and thus forms a pre-assembled component that is provided as such by way of example on a production line during the manufacture of a motor vehicle. The assembly unit is pre-assembled at a remote product site, by way of example a supplier. In the assembled end position, the connection holder is fastened to a carrier component, in particular in a motor vehicle, and the ground contact strip is connected to the carrier component in an electrically conductive manner to form the ground connection. It is preferred that multiple coaxial lines lie in the connection holder and are guided from a first end, which is connected by way of example to an antenna, to a second end, which is connected to a control unit.

Other features which are considered as characteristic for the invention are set forth in the appended claims.

Although the invention is illustrated and described herein as embodied in connection holder for connecting a shielding of at least one coaxial line, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
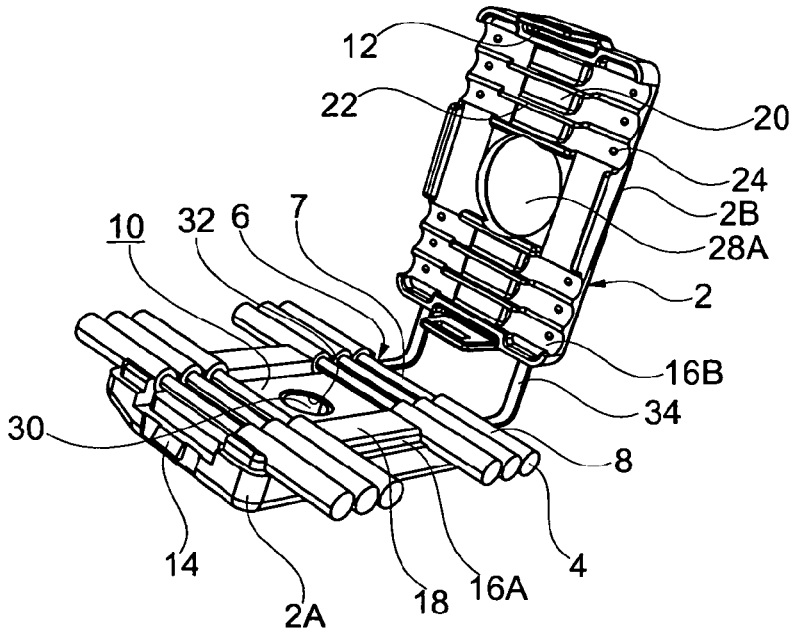
FIG. 1 is a perspective view of a connection holder having two housing halves in the opened position with a total in the exemplary embodiment of six inserted coaxial conductors.
Figure 2:
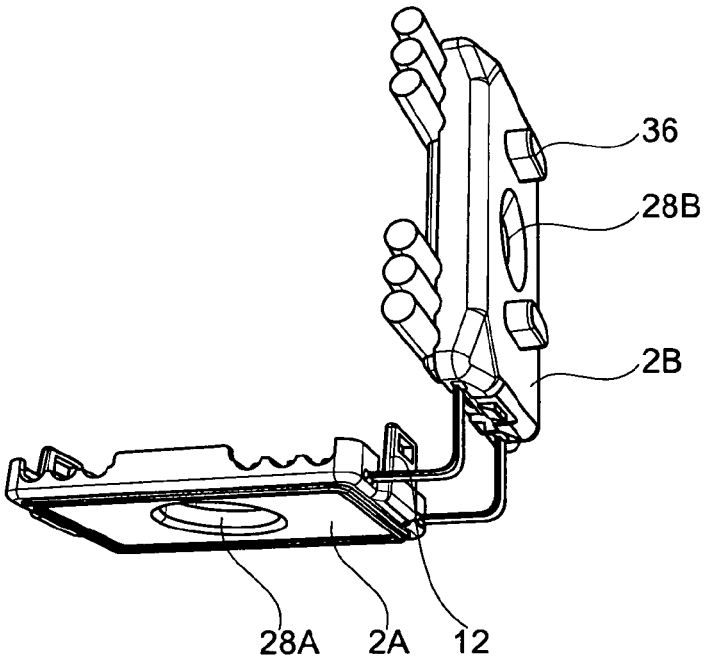
FIG. 2 illustrates the connection holder in accordance with FIG. 1 in a different perspective view.

Referring now to the figures of the drawing in detail and first, particularly, to FIG. 1 thereof, there is shown a connection holder, or common grounding clamp, which comprises an insulating housing 2 formed with a lower shell 2A and an upper shell or cover 2B. Multiple coaxial lines 4 are guided through the housing 2. The coaxial lines 4, or coaxial cables 4, have a contacting region 6 approximately in the middle of the housing. The contacting region 6 has been stripped of the outer insulation sleeve and the outer conductor of the respective coaxial line 4 is exposed. The outer conductor is used as a shield 7.

The coaxial line 4 continues intact on both sides of the contacting region 6 that has been stripped of insulation, in other words said coaxial line still has the usual outer insulation 8 as it enters and also as it exits the housing.

A ground contact strip 10 that is embodied in particular as a sheet metal strip is placed inside the housing 2 and the individual coaxial lines 4 are placed on said ground contact strip with their contacting region 6 that has been stripped of insulation. Said coaxial lines are pressed or rather clamped with their contacting region 6 against the ground contact strip 10 as soon as the housing 2 is closed. For this purpose, the housing comprises a latching lug 12 and a latching protrusion 14 by way of which a particular press-down force is exerted. Half-shell shaped guides 16A, 16B are embodied in the two housing parts 2A, 2B for the purpose of individually guiding the coaxial lines 4 and said half-shell shaped guides come together with a circular cross section to form a guide when the housing 2 is closed. In the lower shell 2A, boundary connecting pieces 18 are embodied on the edge side with respect to the ground contact strip and the ground contact strip 10 is guided and held in said boundary connecting pieces. The half-shell shaped guides 16A are formed in this boundary connecting piece 18.

In order to exert a sufficiently high clamping force, clamping elements 20 are embodied as strips formed as one in the cover 2B in the central region of the half-shell shaped guides 16B. Said clamping elements press the contacting region 6 of the coaxial lines 4 against the ground contact strip 10. Separating pieces 22 are embodied in the cover 2B in each case between two adjacent half-shell shaped guides 16B.

Fixing pins 24 are formed in the half-shell shaped guides 16B, in particular in the cover, where necessary however also in the lower shell 2A. The fixing pins 24 press into the insulation 8 when the housing halves are clamped together. For the purpose of guiding the coaxial lines 4 through the housing 2, said housing comprises in the closed state entry openings 26A, and also exit openings 26B on opposite lying transverse sides (side walls) of the housing 2. The coaxial lines 4 therefore extend through the housing 2 in a transverse direction in a perpendicular manner with respect to the longitudinal direction that is defined by way of the ground contact strip 10.

For the purpose of centering the ground contact strip 10, an annular connecting piece 32 is formed as one on the lower shell 2A and said annular connecting piece penetrates into the through-opening 30 of the ground contact strip 10, however without protruding beyond the ground contact strip 10.

The two housing shells 2A, 2B are permanently connected to one another in a loss-proof manner by way of hinge elements 34 that are embodied as a type of film hinge. Furthermore, fixing or retaining elements 36 are formed as one in the form of connecting pieces on the lower face of the lower shell 2A and said fixing or retaining elements are used for fixing and positioning the housing 2 on the above-mentioned carrier. For this purpose, by way of example receiving devices that correspond to this carrier are illustrated.

Figure 5:
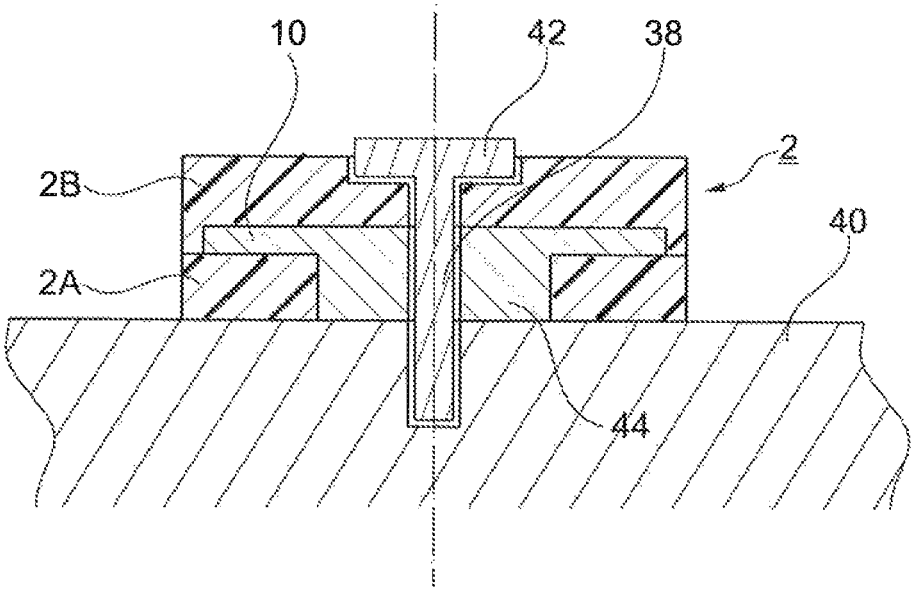
FIG. 5 illustrates a schematic cross section illustration of an alternative embodiment variant in an assembled position on a carrier.

The connection holder is fastened by way of a fastening element that is preferably embodied as a screw 38, as illustrated in FIG. 5, so that the ground contact strip 10 is connected in an electrically conductive manner to a carrier component 40 that forms the ground connection. The carrier component 40 may, in particular, be a bodywork component. The fastening screw is guided from above through the entire housing 2 and through the ground contact strip 10. For this purpose, a first through-opening 28A is formed in the lower shell 2A and a second through-opening 28B is formed in the cover 2B.

Figure 3:
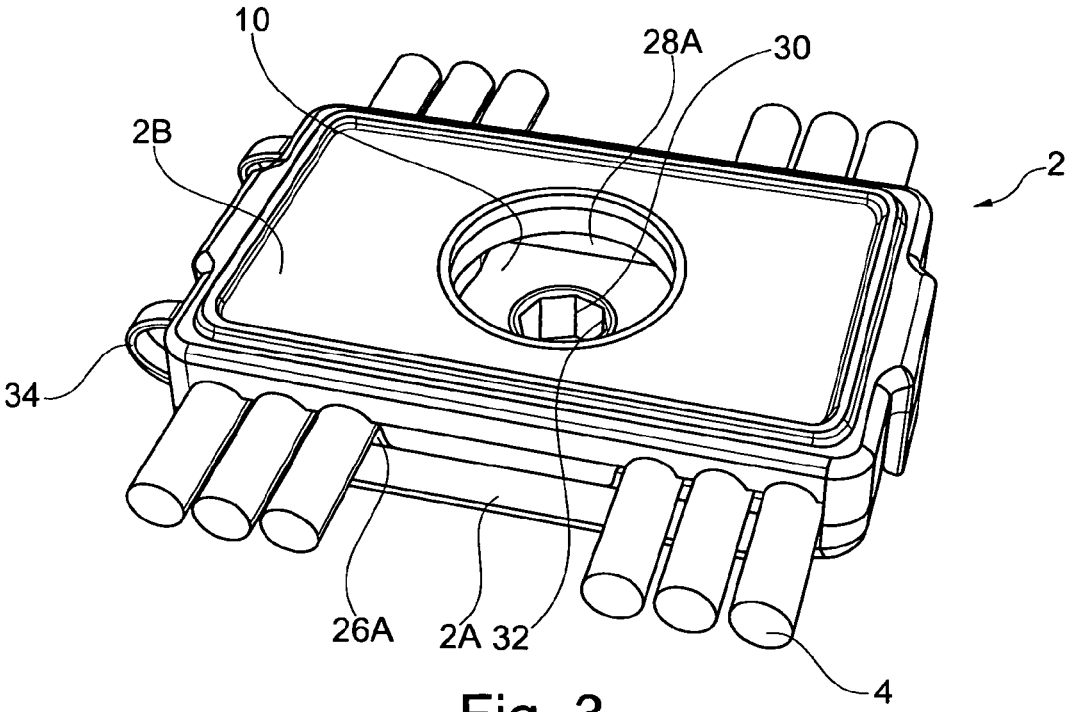
FIG. 3 illustrates the connection holder in accordance with FIG. 1 with the closed housing in a first perspective view of the cover.
Figure 4:
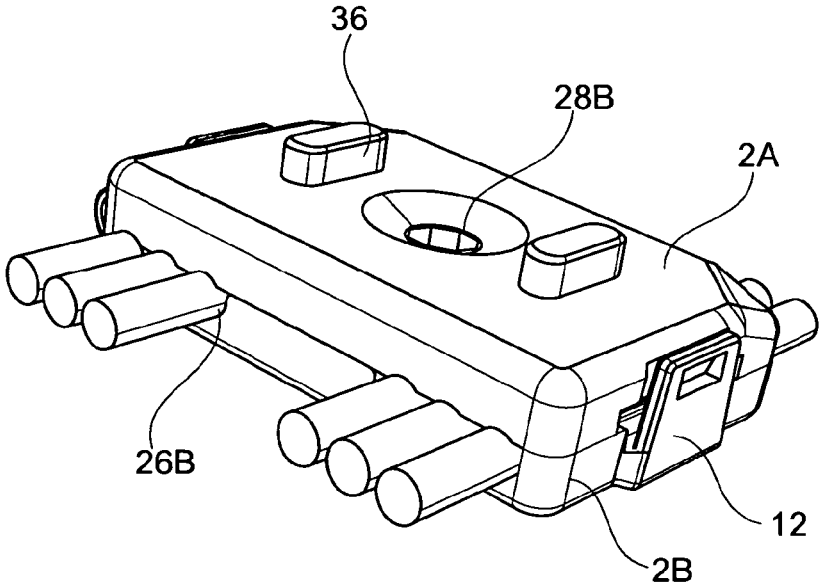
FIG. 4 illustrates the connection holder in accordance with FIG. 1 with the closed housing in perspective further view of the lower shell.

The first through-opening 28A comprises in comparison to the second through-opening 28B in particular in accordance with a first embodiment variant a larger diameter so that the screw head 42 can be guided through the second through-opening 28B in the cover 2B. A through-opening 30 that is likewise embodied in the ground contact strip 10 comprises in contrast thereto a smaller diameter. This situation is illustrated in particular in FIG. 3. By virtue of this feature, the fastening screw 38 therefore comes to lie with its screw head 42 on the ground contact strip 10 and therefore to make electrical contact therewith. By way of the fastening to the carrier component 40, the electrical contact connection (ground connection) is finally made by way of the fastening screw 38.

In accordance with an alternative embodiment variant illustrated in FIG. 5, the electrical contact between the ground contact strip 10 and the carrier component 40 is made by way of a contact protrusion 44 that is electrically conductively connected on one side to the ground contact strip 10 and in particular is a part thereof and formed as one piece thereon. On the other side, the contact protrusion 44 lies on the carrier component 40 and is in electrical contact therewith.

The housing 2 is fastened in turn by way of the screw 38. In an alternative embodiment, the screw may not contact the ground contact strip 10 with its screw head 42 but rather the screw lies in an opening of the cover 2A. As a result, this exerts a clamping and press-down force on the cover 2A by way of the screw 38. The contact protrusion 44 is embodied preferably as a bent-over connecting piece, in particular an annular connecting piece through which the screw 38 is guided in a central manner.

The following is a summary list of reference numerals and the corresponding structure used in the above description of the invention:

2 Housing
2A Lower shell
2B Cover
4 Coaxial line
6 Contacting region
7 Shield
8 Insulation
10 Ground contact strip
12 Latching lug
14 Latching protrusion
16A, B Half-shell shaped guide
18 Boundary connecting piece
20 Clamping element
22 Separating piece
24 Fixing pins
26A, B Entry opening and Exit opening
28A First through-opening
28B Second through-opening
30 Through-opening
32 Annular connecting piece
34 Hinge elements
36 Fixing elements
38 Screw
40 Carrier component
42 Screw head
44 Contact protrusion

The invention claimed is:

1. A connection holder for electrically connecting a shielding of at least of one coaxial line to a carrier component located externally from the connection holder, the coaxial line having a shielding encased by an outer insulation, the holder comprising:

a housing configured to receive the at least one coaxial line;

a ground contact strip having an opening formed therein, said ground contact strip disposed in said housing; and a fastening element;

the at least one coaxial line having a contacting region where the outer insulation has been stripped and the shielding is exposed for placement on, and clamping against, said ground contact strip;

said ground contact strip being disposed in said housing to make direct contact with ground potential when the connection holder is fastened to a carrier component;

said housing including a first shell with an opening formed therethrough and a second shell with an opening formed therethrough that is located opposite said opening in said first shell; and said fastening element extending at least through said opening in said first shell and said opening in said ground contact strip for electrically connecting said ground contact strip to the carrier component when the connection holder is fastened to the carrier component;

wherein said fastening element is a screw bolt with a screw head lying directly on said ground contact strip, and said fastening element has a foot region forming an electrical contact with the carrier component via said opening in said second shell when the connection holder is fastened to the carrier component, and said ground contact strip includes a contact protrusion.

2. The connection holder according to claim 1, wherein said housing is configured to guide therethrough the at least one coaxial line in a straight alignment, said housing having an entry opening and an exit opening for a respective coaxial line.

3. The connection holder according to claim 1, wherein said housing is configured for receiving a plurality of coaxial lines to be placed in parallel adjacent to one another and in common on said ground contact strip.

4. The connection holder according to claim 1, wherein said ground contact strip is an insert part.

5. The connection holder according to claim 1, which comprises shell-shaped guides formed for individually guiding each coaxial line.

6. The connection holder according to claim 1, wherein the at least one coaxial line can be clamped between said first shell and said second shell.

7. The connection holder according to claim 1, wherein said first shell and said second shell are configured to be latched with one another.

8. The connection holder according to claim 1, wherein said ground contact strip extends in a longitudinal direction of said housing and the at least one coaxial line is insertable in a transverse direction thereto, and wherein said ground contact strip is laterally held by oppositely lying boundary connecting pieces of said housing.

9. The connection holder according to claim 8, which comprises shell-shaped guides formed for individually guiding each coaxial line and formed in said boundary connecting pieces for clampingly fixing in each case a respective coaxial line.

10. The connection holder according to claim 1, wherein said housing comprises a respective clamping element for each coaxial line and for pressing the contacting region of each coaxial line that has been stripped of insulation against said ground contact strip.

11. The connection holder according to claim 1, wherein said housing comprises fixing pins for each respective coaxial line.

12. The connection holder according to claim 11, wherein the fixing pins are embodied for providing a clamping force against the coaxial line.

13. The connection holder according to claim 1, wherein said housing is formed on each side of said through-opening for receiving a plurality of coaxial lines.

14. The connection holder according to claim 1, wherein said housing comprises an annular connecting piece that engages in said through-opening for centering and fixing said ground contact strip.

15. The connection holder according to claim 1, wherein said housing has an outer face formed with fixing elements for affixing to a carrier component.

16. The connection holder according to claim 1, wherein multiple coaxial lines are guided through said housing and said coaxial lines are stripped of insulation only in a central contacting region, thus exposing a shielding and pressing the shielding in contact against said ground contact strip, and wherein each respective coaxial line is clampingly held on both sides of said contacting region in said housing.

17. The connection holder according to claim 1, wherein said fastening element also clamps the carrier component to said second shell.

18. The connection holder according to claim 1, wherein said first shell is a cover and said second shell is a lower shell.

* * * * *